US008911257B2

(12) United States Patent
Kang et al.

(10) Patent No.: US 8,911,257 B2
(45) Date of Patent: Dec. 16, 2014

(54) CONNECTOR

(71) Applicant: Delta Electronics, Inc., Taoyuan Hsien (TW)

(72) Inventors: Ying-Chian Kang, Taoyuan Hsien (TW); Chin-Chung Tai, Taoyuan Hsien (TW); Shou-Cheng Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/707,288

(22) Filed: Dec. 6, 2012

(65) Prior Publication Data

US 2014/0024265 A1 Jan. 23, 2014

(30) Foreign Application Priority Data

Jul. 23, 2012 (TW) ..... 101126411 A

(51) Int. Cl.

| | |
|---|---|
| ***H01R 13/66*** | (2006.01) |
| ***H01R 24/00*** | (2011.01) |
| *H01R 13/719* | (2011.01) |
| *H01R 13/6461* | (2011.01) |
| *H01R 24/64* | (2011.01) |

(52) U.S. Cl.

CPC ..... *H01R 23/025* (2013.01); *H01R 13/719* (2013.01); *H01R 13/6633* (2013.01); *H01R 13/6461* (2013.01); *H01R 24/64* (2013.01)

USPC ..... 439/620.12

(58) Field of Classification Search

USPC ..... 439/676, 620.06, 620.07, 620.11, 439/620.12, 620.17

See application file for complete search history.

(56) References Cited

U.S. PATENT DOCUMENTS

| | | | | |
|---|---|---|---|---|
| 5,015,981 | A * | 5/1991 | Lint et al. | 336/65 |
| 5,475,347 | A * | 12/1995 | Kwak | 333/185 |
| 6,171,152 | B1 * | 1/2001 | Kunz | 439/620.18 |
| 6,811,442 | B1 * | 11/2004 | Lien et al. | 439/620.07 |
| 6,878,012 | B2 * | 4/2005 | Gutierrez et al. | 439/607.26 |
| 6,986,684 | B1 * | 1/2006 | Lien | 439/620.07 |
| 7,821,374 | B2 * | 10/2010 | Harrison et al. | 336/229 |
| 8,203,418 | B2 * | 6/2012 | Harrison et al. | 336/200 |
| 8,535,100 | B2 * | 9/2013 | Ge et al. | 439/620.17 |

FOREIGN PATENT DOCUMENTS

| | | |
|---|---|---|
| TW | M339129 | 8/2008 |
| TW | M341971 | 10/2008 |

* cited by examiner

*Primary Examiner* — Neil Abrams

*Assistant Examiner* — Travis Chambers

(74) *Attorney, Agent, or Firm* — Kirton McConkie; Evan R. Witt

(57) ABSTRACT

A connector comprises a housing, a plurality of contact terminals and a signal processing module. The housing has a receiving hole for receiving a plug. The plurality of contact terminals are disposed in the housing for being connected with the plug. The signal processing module is electrically connected with the contact terminals and has a first magnetic component, wherein the first magnetic component comprises a base and a plurality of magnetic cores, the base has a plurality of through holes, each of which has substantially the same size as that of the magnetic core so that the magnetic core is fixed in the through hole, and distances between adjacent two through holes are the same.

21 Claims, 4 Drawing Sheets

CONNECTOR

FIELD OF THE INVENTION

The present invention relates to a connector, and more particularly to a connector applied to network communication.

BACKGROUND OF THE INVENTION

With the development of the network communication techniques, the network connectors have been widely used in computers and various network equipments. RJ connectors are the most common network connectors, such as RJ11, RJ12 and RJ14 connectors using 4 pins or 6 pins for connection, and RJ45 connectors using 8 pins for connection, wherein RJ11 connectors are mainly used in telecommunication network and in charge of connections for telephone lines, and RJ45 connectors are mainly used in connections between network equipments for local area network (LAN) and asymmetric digital subscriber line (ADSL).

When two network communication devices are connected through a connector plug and a socket, the network signals are able to be transmitted from the first device to the second device. During the signal transmission process, the electromagnetic interference (EMI) is generated to cause the surrounding electronic components or circuits, resulting in erroneous signal transmission. Therefore, to avoid the electromagnetic interference and maintain the completeness of the signal, a metal cover is used to cover the exterior of the connector and a filter is arranged in the interior of the connector, wherein the filter can filter out unnecessary noises of the external network signal transmitted from the network connector.

Please refer to FIG. 1, which is a schematic diagram of a conventional filter. The conventional filter 10 includes a base 11, a plurality of magnetic cores 12, a plurality of first pins 13 and a plurality of second pins 14. The plurality of first pins 13 and the plurality of second pins 14 extend from the upper and lower sides of the base 11, respectively. The plurality of magnetic cores 12 are received in the receiving space formed in the center of the base 11. The winding is wound around the circular magnetic core 12, and then the end of the winding is connected to the first pin 13.

However, in the conventional connector, since the base 11 does not provide any position or separation structures for the magnetic cores 12, the plurality of magnetic cores 12 are randomly arranged in the receiving space of the base 11, and thus the distances between the signal channels formed by the magnetic cores 12 are not fixed. When the distance between any two magnetic cores 12 is too small, the cross-talk is easily caused between the signal channels, and even the erroneous signal transmission may be occurred.

SUMMARY OF THE INVENTION

The present invention provides a connector applied to the network communication and has a magnetic component for filtering. By fixing the distances between adjacent two magnetic cores of the magnetic component, the distances between the signal channels are big and can be fixed so as to avoid the cross-talk problem resulted from the conventional connector due to that the distances between the signal channels are not fixed.

In accordance with an aspect of the present invention, the connector includes a housing, a plurality of contact terminals and a signal processing module. The housing has a receiving hole for receiving a plug. The plurality of contact terminals are disposed in the housing for being connected with the plug. The signal processing module is electrically connected with the contact terminals and has a first magnetic component, wherein the first magnetic component includes a base and a plurality of magnetic cores, the base has a plurality of through holes, each of which has substantially the same size as that of the magnetic core so that the magnetic core is fixed in the through hole, and distances between adjacent two through holes are the same.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
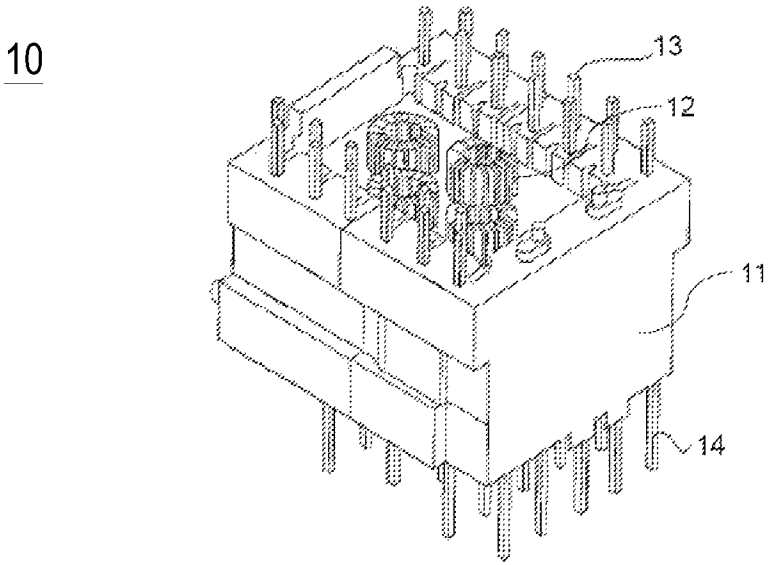
FIG. 1 (PRIOR ART)
FIG. 1 shows a schematic view of a conventional filter.
Figure 2:
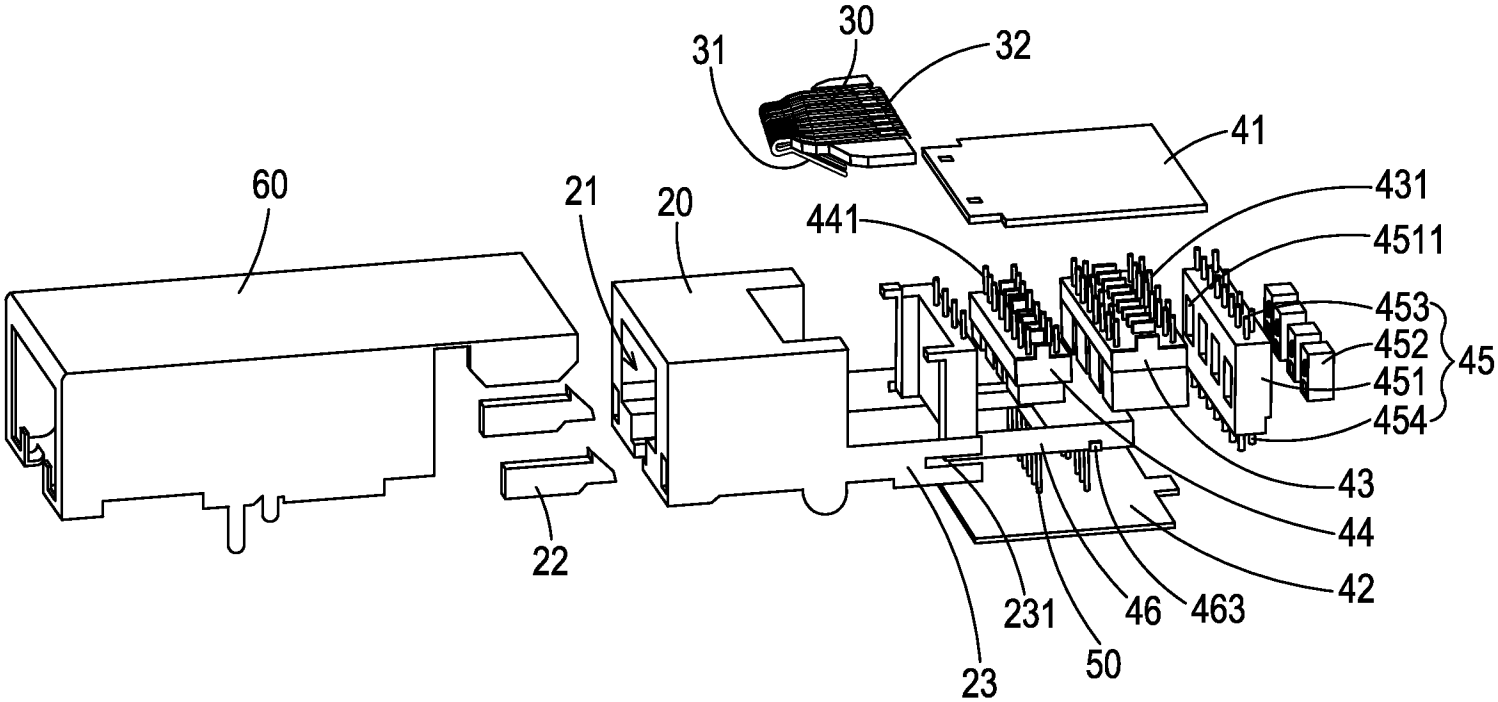
FIG. 2 illustrates an exploded view of the connector applied to network communication according to a preferred embodiment of the present invention.
Figure 3:
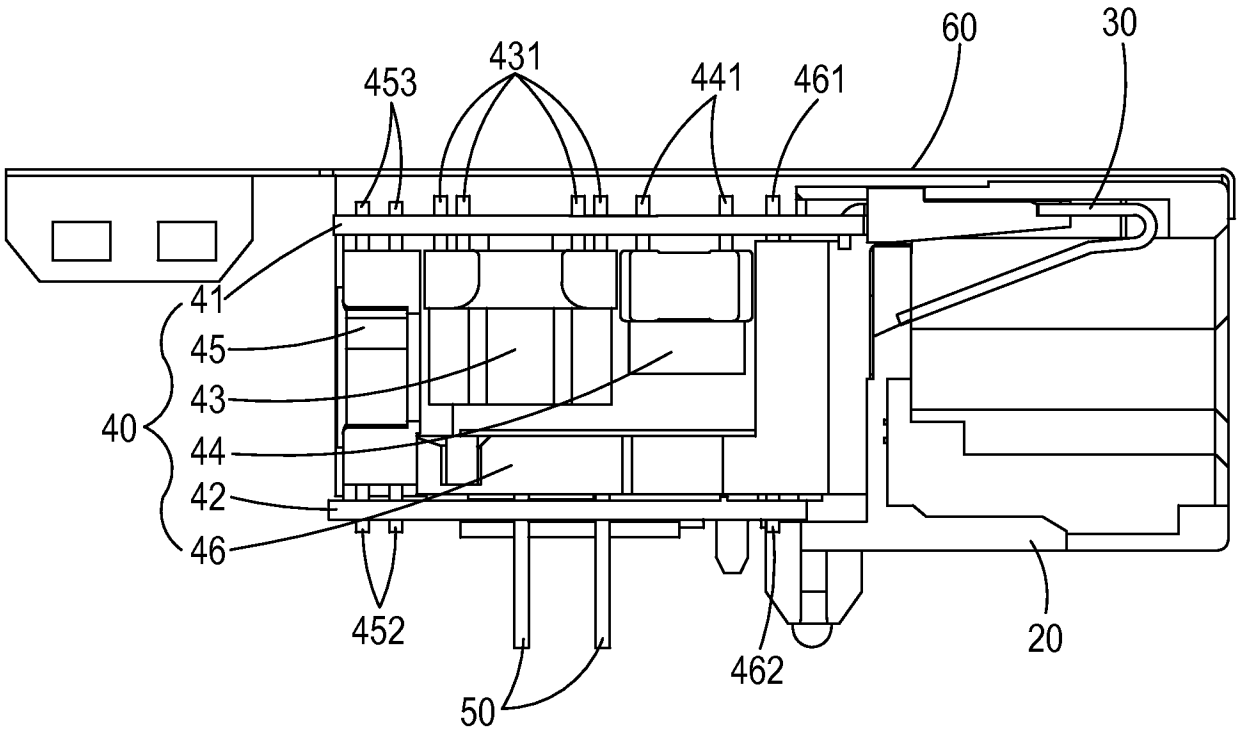
FIG. 3 illustrates a cross-sectional view of the connector applied to network communication according to a preferred embodiment of the present invention.

Please refer to FIGS. 2 and 3, which illustrate an exploded view and a cross-sectional view of the connector applied to the network communication according to a preferred embodiment of the present invention. The connector applied to network communication mainly includes a housing 20, a plurality of contact terminals 30, a signal processing module 40, a plurality of terminals 50 and a metal cover 60.

The connector is an RJ connector, such as the RJ45 connector shown in FIG. 2. However, the techniques of the present invention are not limited to the RJ45 connector, but also applied to other RJ connectors, such as RJ11, RJ12 and RJ14 connectors, or other types of the network connectors.

The housing 20 has a receiving hole 21 for receiving a plug having a corresponding structure (not shown). The plurality of contact terminals 30 have respective first ends 31 and second ends 32, wherein the first ends 31 extend into the housing 20 to be connected with the plug, and the second ends 32 are connected with the signal processing module 40.

A light guide 22 is mounted in the housing 20 and emits a light to indicate if the plug and the contact terminals 30 are well connected.

The signal processing module 40 is used to adjust and filter the network signals transmitted from the plug through the contact terminals 30. The signal processing module 40 includes a first circuit board 41, a second circuit board 42, a first magnetic component 45, a second magnetic component 44 and a third magnetic component 43. The second ends 32 of the contact terminals 30 are connected with the first circuit board 41. The first circuit board 41 and the second circuit board 42 are substantially disposed in parallel, and the first magnetic component 45, the second magnetic component 44 and the third magnetic component 43 are disposed between the first circuit board 41 and the second circuit board 42.

The first magnetic component 45 is a filter, and includes a base 451, a plurality of magnetic cores 452, a plurality of first pins 453 and a plurality of second pins 454. The plurality of first pins 453 and the plurality of second pins 454 extend from the upper and lower sides of the base 451 to be inserted into the first circuit board 41 and the second circuit board 42, respectively. The third magnetic component 43 is a transformer, such as a pulse transformer, and includes a plurality of pins 431 to be inserted into the first circuit board 41. The second magnetic component 44 is a common-mode filter, and includes a plurality of pins 441 to be inserted into the first circuit board 41.

As shown in FIG. 3, the signal processing module 40 further includes a terminal seat 46, and the first circuit board 41 and the second circuit board 42 are disposed above and under the terminal seat 46, respectively. The terminal seat 46 includes a plurality of first pins 461 and a plurality of second pins 462, which extend from the upper and lower sides of the terminal seat 46 and are inserted into the first circuit board 41 and the second circuit board 42, respectively. In addition, the terminal seat 46 further includes a plurality of terminals 50, which extend downwardly from the terminal seat 46 and penetrate the second circuit board 42 to be inserted into and connected with a mother board (not shown) so that the network signal can be transmitted from the plug through the plurality of contact terminals 30, the signal processing module 40 and the plurality of terminals 50 to the mother board.

The housing 20, the base 451 and the terminal seat 46 are made of insulating material, such as plastic, but not limited thereto. The contact terminals 30, the terminals 50 and the pins 431, 441, 453, 454, 461 and 462 are made of conductive metal, such as copper or copper alloy, but not limited thereto.

Please refer to FIG. 2, the housing 20 further includes two extension arms 23 disposed at two lateral sides thereof, and a slit 231 is formed at the front end of each of the extension arm 23. Corresponding to the slits 231, two protrusions 463 are formed at the two lateral sides of the terminal seat 46. When the housing 20 is assembled with the signal processing module 40, the two protrusions 463 at the two lateral sides of the terminal seat 46 are slid into and engaged with the two slits 231 on the two extension arms 23 of the insulation housing 20, respectively.

The metal cover 60 covers the assembled structure of the housing 20, the plurality of contact terminals 30, the signal processing module 40 and the plurality of conducing terminals 50 for providing EMI shielding. The metal cover 60 has an opening corresponding to the housing 20 so that the plug can be plugged into the receiving hole 21 of the housing 20 and conduct with the contact terminals 30. The metal cover 60 also has an opening corresponding to the light guide 22 so as to emit the LED light. Moreover, the metal cover 60 does not cover the bottom of the signal processing module 40 so that the plurality of terminals 50 are exposed so as to be inserted into the mother board. The metal cover 60 is preferably a steel cover, but not limited thereto.

Figure 4:
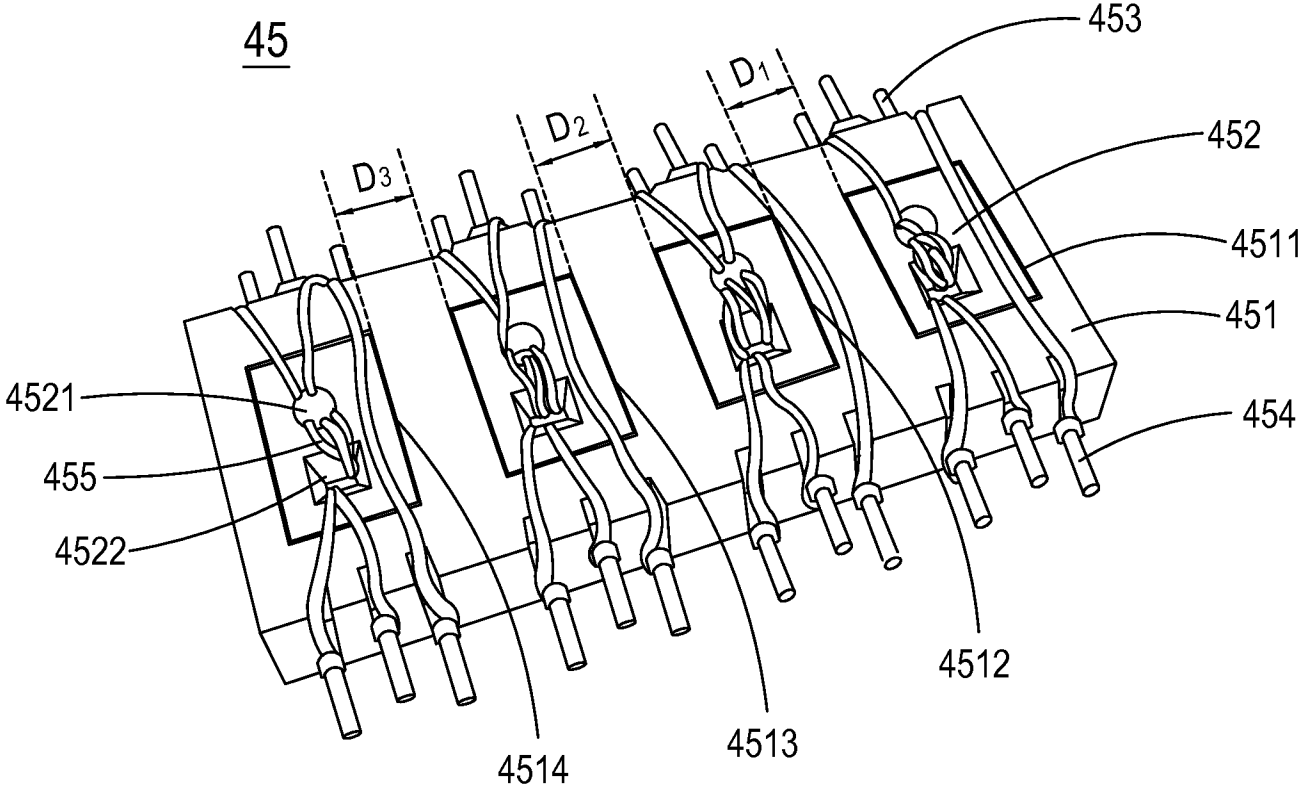
FIG. 4 illustrates a schematic view of the first magnetic component according to a preferred embodiment of the present invention.

Please refer to FIGS. 2 and 4, wherein FIG. 4 is a schematic diagram of the first magnetic component according to a preferred embodiment of the present invention. The base 451 of the first magnetic component 45 is a monolithic structure and has a plurality of through holes 4511, 4512, 4513, 4514 each of which is used to receive one magnetic core 452 therein. The through hole 4511, 4512, 4513, 4514 has substantially the same size as that of the magnetic core 452 so that the magnetic core 452 is received and fixed in the through hole 4511, 4512, 4513, 4514, and the distances between adjacent through holes 4511, 4512, 4513, 4514 are the same. For example, as shown in FIG. 4, the plurality of through holes includes a first through hole 4511, a second through hole 4512, a third through hole 4513 and a forth through hole 4514, and the distance D1 between the first through hole 4511 and the second through hole 4512, the distance D2 between the second through hole 4512 and the third through hole 4513 and the distance D3 between the third through hole 4513, and the fourth through hole 4514 are the same. Therefore, when the magnetic cores 452 are received in the through holes 4511, 4512, 4513, 4514, the distances between adjacent signal channels formed by the magnetic cores 452 will be the same. Besides, the magnetic cores 452 may be fixed in the through holes 4511, 4512, 4513, 4514 by means of tight-fitting, interference fit or block, wherein the block may be a hook, an engaging element or glue. Since the size and the shape of the through hole 4511, 4512, 4513, 4514 on the base 451 are corresponding to those of the magnetic core 452 to firmly receive the magnetic core 452 therein, the magnetic cores 452 can be separated and positioned by the walls between the through holes 4511, 4512, 4513, 4514, and thus the distances between the signal channels are big and can be fixed so as to avoid the cross-talk problem resulted from the conventional connector due to that the distances between the signal channels are not fixed.

The magnetic core 452 is preferably a Balun core having a first hole 4521 and a second hole 4522, and the winding is wound between the first hole 4521 and the second hole 4522 and connected to the first pin 453 or the second pin 454. Therefore, compared with the conventional circular magnetic cores having altered distances after the windings are wound thereon, the arrangement of the magnetic cores 452 and the base 451 of the present invention can more effectively control the distances between the signal channels.

The magnetic core 452 and the through hole 4511 are substantially in a rectangular shape, but not limited thereto. For example, they may also be circular, elliptic or 8-shaped.

The holes 4521 and 4522 are respectively a circular hole and a rectangular hole, but not limited thereto. For example, they may be rectangular holes, circular holes or elliptic holes.

Preferably, the magnetic core 452 and the through hole 4511 are interference fit so that the magnetic core 452 is tightly fixed in the through hole 4511.

In conclusion, the connector applied to network communication according to the present invention mainly includes the housing, the plurality of contact terminals, the signal processing module, the plurality of terminals and the metal cover. The signal processing module includes the first circuit board, the second circuit board, the first magnetic component, the second magnetic component and the third magnetic component. The first magnetic component includes the base and the plurality of magnetic cores, wherein the base has the plurality of through holes, each of which has substantially the same size as that of the magnetic core so that the magnetic core can be fixed in the through hole by means of tight-fitting, interference fit or block, and the distances between adjacent through holes are the same. Accordingly, when the magnetic cores are received in the through holes, the distances between adjacent signal channels formed by the magnetic cores will be the same. Therefore, since the size and the shape of the through hole on the base are corresponding to those of the magnetic core to firmly receive the magnetic core therein, the magnetic cores can be separated and positioned by the walls between the through holes, and thus the distances between the signal channels are big and can be fixed so as to avoid the cross-talk problem resulted from the conventional connector.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector comprising:

a housing having a receiving hole for receiving a plug;

a plurality of contact terminals disposed in said housing for being connected with said plug; and a signal processing module electrically connected with said contact terminals and having a first magnetic component, wherein said first magnetic component comprises a base and at least three magnetic cores, said base has at least three through holes including a first through hole, a second through hole and a third through hole, each of which has substantially the same size as that of said magnetic core so that said magnetic core is fixed in said through hole, and a distance between said first through hole and said second through hole and a distance between said second through hole and said third through hole are the same.

2. The connector according to claim 1, wherein said magnetic core of said first magnetic component is a Balun core.

3. The connector according to claim 1, wherein said housing further comprises a light guide to emit a light.

4. The connector according to claim 1, wherein said plurality of contact terminals have respective first ends and second ends, wherein said first ends extend into said housing, and said second ends are connected with said signal processing module.

5. The connector according to claim 1, further comprising a metal cover covering an assembled structure of said housing, said plurality of contact terminals and said signal processing module.

6. The connector according to claim 1, wherein said connector is an RJ45 connector.

7. The connector according to claim 1, wherein said base of said first magnetic component is a monolithic structure.

8. The connector according to claim 1, wherein said magnetic core and said through hole are substantially rectangular, circular, elliptic or 8-shaped.

9. The connector according to claim 1, wherein said first magnetic component further comprises a plurality of first pins and a plurality of second pins, and said plurality of first pins and said plurality of second pins extend from upper and lower sides of said base, respectively.

10. The connector according to claim 9, wherein said magnetic core has a first hole and a second hole, and a winding is wound between said first hole and said second hole and connected to said first pin or said second pin.

11. The connector according to claim 10, wherein said first hole and said second hole are respectively selected from a group consisting of a circular hole, a rectangular hole and an ellipse hole.

12. The connector according to claim 1, wherein said magnetic core is fixed in said through hole by means of tight-fitting, interference fit or block.

13. The connector according to claim 12, wherein said block is a hook, an engaging element or glue.

14. The connector according to claim 1, wherein said signal processing module further comprises a first circuit board, a second circuit board, a second magnetic component and a third magnetic component, said first circuit board and said second circuit board are substantially disposed in parallel, and said first magnetic component, said second magnetic component and said third magnetic component are disposed between said first circuit board and said second circuit board.

15. The connector according to claim 14, wherein said first magnetic component is a filter, said second magnetic component is a common-mode filter, and said third magnetic component is a transformer.

16. The connector according to claim 14, wherein said second magnetic component and said third magnetic component respectively comprises a plurality of pins to be inserted into said first circuit board.

17. The connector according to claim 14, wherein said signal processing module further comprises a terminal seat, and said first circuit board and said second circuit board are disposed above and under said terminal seat, respectively.

18. The connector according to claim 17, wherein said terminal seat comprises a plurality of terminals extending downwardly from said terminal seat for connecting with a mother board, and said terminal seat further comprises a plurality of first pins and a plurality of second pins, which extend from upper and lower sides of said terminal seat and are inserted into said first circuit board and said second circuit board, respectively.

19. The connector according to claim 17, wherein said housing further comprises two extension arms, a slit is formed on an front end of each of said extension arm, and two protrusions are formed at two lateral sides of said terminal seat for being engaged in said slits.

20. A connector comprising:

a housing having a receiving hole for receiving a plug;

a plurality of contact terminals disposed in said housing for being connected with said plug; and a signal processing module electrically connected with said contact terminals and having a first magnetic component, wherein said first magnetic component comprises a base, a plurality of magnetic cores, a plurality of first pins and a plurality of second pins, said base has a plurality of through holes, each of which has substantially the same size as that of said magnetic core so that said magnetic core is fixed in said through hole, and distances between said adjacent two through holes are the same, said plurality of first pins and said plurality of second pins extend from upper and lower sides of said base, respectively, said magnetic core has a first hole and a second hole, and a winding is wound between said first hole and said second hole and connected to said first pin or said second pin.

21. A connector comprising:

a housing having a receiving hole for receiving a plug;

a plurality of contact terminals disposed in said housing for being connected with said plug; and a signal processing module electrically connected with said contact terminals and having a first magnetic component, a second magnetic component, a third magnetic component, a first circuit board and a second circuit board, wherein said first circuit board and said second circuit board are substantially disposed in parallel, and said first magnetic component, said second magnetic component and said third magnetic component are disposed between said first circuit board and said second circuit board, wherein said first magnetic component comprises a base and a plurality of magnetic cores, said base has a plurality of through holes, each of which has substantially the same size as that of said magnetic core so that said magnetic core is fixed in said through hole, and distances between said adjacent two through holes are the same.

* * * * *